US010508351B2

(12) United States Patent
Joi et al.

(10) Patent No.: US 10,508,351 B2
(45) Date of Patent: Dec. 17, 2019

(54) LAYER-BY-LAYER DEPOSITION USING HYDROGEN

(71) Applicant: Lam Research Corporation, Fremont, CA (US)

(72) Inventors: Aniruddha Joi, San Jose, CA (US); Yezdi Dordi, Palo Alto, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 15/913,542

(22) Filed: Mar. 6, 2018

(65) Prior Publication Data

US 2018/0266001 A1 Sep. 20, 2018

Related U.S. Application Data

(60) Provisional application No. 62/472,321, filed on Mar. 16, 2017.

(51) Int. Cl.

| | |
|---|---|
| ***C25D 5/10*** | (2006.01) |
| ***C25D 5/18*** | (2006.01) |
| ***C25D 5/48*** | (2006.01) |
| ***C23C 18/16*** | (2006.01) |
| ***C25D 21/12*** | (2006.01) |
| ***C23C 18/54*** | (2006.01) |
| ***C25D 9/08*** | (2006.01) |

(52) U.S. Cl.

CPC ..... *C25D 5/10* (2013.01); *C23C 18/1651* (2013.01); *C23C 18/54* (2013.01); *C25D 5/18* (2013.01); *C25D 5/48* (2013.01); *C25D 9/08* (2013.01); *C25D 21/12* (2013.01)

(58) Field of Classification Search

CPC .. C23C 18/54; C23C 16/45525–45555; H01L 21/3141

See application file for complete search history.

(56) References Cited

U.S. PATENT DOCUMENTS

| | | | | |
|---|---|---|---|---|
| 6,126,798 | A | 10/2000 | Reid et al. | |
| 6,156,167 | A | 12/2000 | Patton et al. | |
| 6,165,912 | A * | 12/2000 | McConnell ..... | C23C 18/1831 257/E21.174 |

(Continued)

FOREIGN PATENT DOCUMENTS

| | | | |
|---|---|---|---|
| JP | S57-200550 | A * | 12/1982 |
| JP | 2013-118341 | | 6/2013 |
| KR | 10-2010-0109035 | | 10/2010 |

OTHER PUBLICATIONS

Kita et al., Machine Translation, JP S57-200550 A (Year: 1982).*

(Continued)

*Primary Examiner* — Brian W Cohen
*Assistant Examiner* — Ho-Sung Chung
(74) *Attorney, Agent, or Firm* — Weaver Austin Villeneuve & Sampson LLP

(57) ABSTRACT

Layer-by-layer thickness control of an electroplated film can be achieved by using a cyclic deposition process. The cyclic process involves forming a layer (or partial layer) of hydrogen on a surface of the substrate, then displacing the layer of hydrogen with a layer of metal. These steps are repeated a number of times to deposit the metal film to a desired thickness. Each step in the cycle is self-limiting, thereby enabling atomic level thickness control.

20 Claims, 7 Drawing Sheets

(56) References Cited

U.S. PATENT DOCUMENTS

| | | | | |
|---|---|---|---|---|
| 6,569,299 | B1 | 5/2003 | Reid et al. | |
| 6,800,187 | B1 | 10/2004 | Reid et al. | |
| 8,084,339 | B2 | 12/2011 | Antonelli et al. | |
| 8,217,513 | B2 | 7/2012 | Antonelli et al. | |
| 8,753,978 | B2 | 6/2014 | Yu et al. | |
| 8,864,935 | B2 | 10/2014 | Fair et al. | |
| 8,916,022 | B1 | 12/2014 | Caron | |
| 9,234,276 | B2 | 1/2016 | Varadarajan | |
| 9,371,579 | B2 | 6/2016 | Varadarajan et al. | |
| 9,591,738 | B2 | 3/2017 | Qiu et al. | |
| 2005/0112873 | A1 | 5/2005 | Zangmeister et al. | |
| 2007/0082474 | A1* | 4/2007 | Shih | C23C 18/1601 438/597 |
| 2008/0156264 | A1 | 7/2008 | Fair et al. | |
| 2010/0124609 | A1* | 5/2010 | Quick | C23C 16/45527 427/255.28 |
| 2010/0133107 | A1 | 6/2010 | Fishelson et al. | |
| 2010/0317198 | A1 | 12/2010 | Antonelli et al. | |
| 2011/0129688 | A1* | 6/2011 | Ito | C23C 18/1637 428/674 |
| 2013/0323930 | A1 | 12/2013 | Chattopadhyay et al. | |
| 2014/0057453 | A1 | 2/2014 | Madocks et al. | |
| 2016/0047050 | A1* | 2/2016 | Peng | C23C 18/166 427/213.31 |

OTHER PUBLICATIONS

Kita et al., Partial Human Translation, JP S57-200550 A (Year: 1982).*

Brankovic, S.R., et al., "Metal Monolayer Deposition by replacement of Metal Adlayers on Electrode Surfaces," Surface Science, vol. 474, 2001, pp. L173-L179.

Thambidurai, C., et al., "Copper Nano Film Formation Using Electrochemical ALD," ECS Transactions, The Electrochemical Society, vol. 11, No. 7, 2007, pp. 103-112.

Gregory, B. W., et al., Electrochemical Atomic Layer Epitaxy (ECALE), j. Electroanal. Chem, vol. 300, 1991, pp. 543-561.

Kim, J.Y., et al., "Copper Nanofilm Formation by Electrochemical Atomic Layer Deposition," Journal of the Electrochemical Society, vol. 154, No. 4, 2007, pp. D260-D266.

Viyannalage, L.T., "Epitaxial Growth of Cu on Au(111) and Ag(111) by Surface Limited Redox Replacements—An Electrochemical and STM Study," J. Phys. Chem. C., 2007, vol. 111, pp. 4036-4041.

Greeley, Jeff, et al., "Surface and Subsurface Hydrogen: Adsorption Properties on Transition Metals and Near-Surface Alloys," J. Phys. Chem. B., vol. 109, Chemical Society, 2005, pp. 3460-3471.

International Search Report and Written Opinion dated Jun. 21, 2018, issued in Application No. PCT/US2018/021406.

* cited by examiner

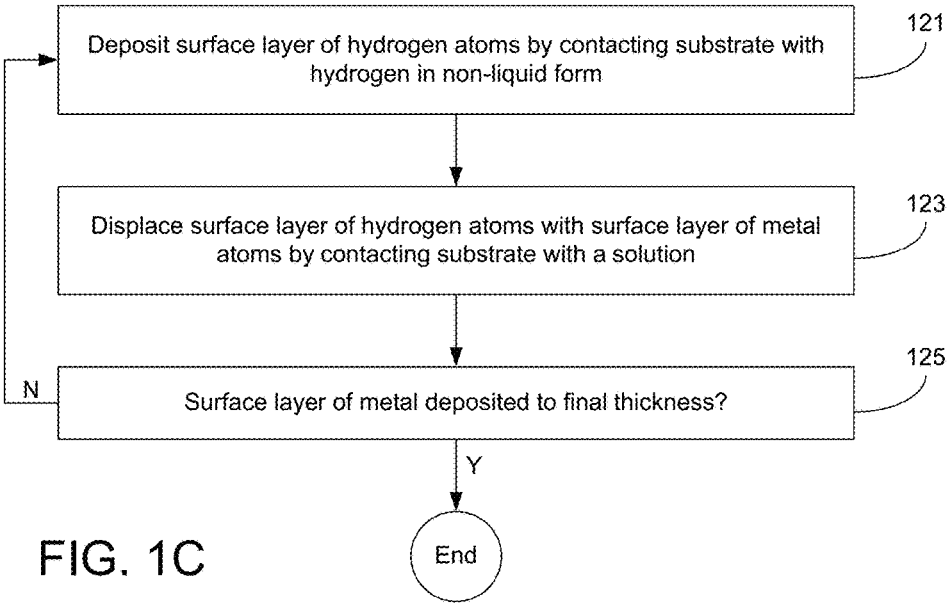
FIG. 1C
FIG. 2
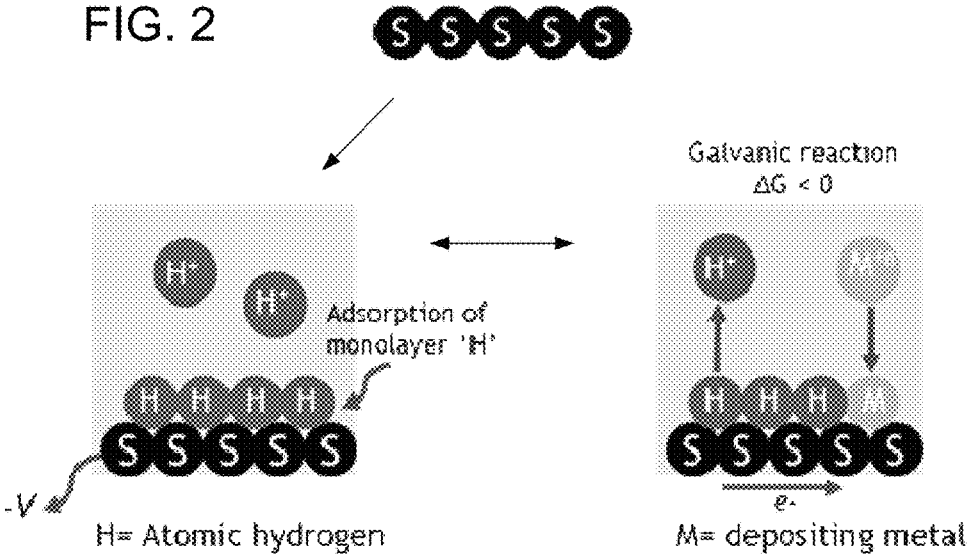

LAYER-BY-LAYER DEPOSITION USING HYDROGEN

CROSS-REFERENCE TO RELATED APPLICATION

This application claims the benefit of priority under 35 U.S.C. § 119(e) to U.S. Provisional Application No. 62/472,321, filed Mar. 16, 2017, titled "LAYER-BY-LAYER DEPOSITION USING HYDROGEN," all of which is incorporated herein by this reference and for all purposes.

BACKGROUND

With progressing technology nodes, feature sizes in integrated circuit designs are shrinking. The features in question include conductive lines typically fabricated during back-end processing. It is becoming increasingly important to be able to deposit metals with a high degree of thickness control (e.g., deposit a layer of atomic dimensions). Currently many metal deposition back-end processes (e.g., copper conductive line formation) are accomplished by physical vapor deposition (PVD). Unfortunately, PVD relies on line-of-sight deposition which limits its use in narrow, high aspect ratio structures that will be used in aggressive nodes. PVD cannot offer the required thickness control. Alternatively, atomic layer deposition (ALD) techniques can be used to form metal layers with a high degree of thickness control. However, such techniques present various drawbacks such as expensive precursors and inclusion of carbon contaminants in the resulting film.

SUMMARY

In certain aspects of this disclosure, methods and systems employ electrochemical processes for layer-by-layer growth of certain metals. The layer-by-layer by growth is enabled by electrochemical deposition of hydrogen on a metallic or other conductive substrate. Electrochemically reduced hydrogen ions ($H^+$) form a hydrogen monolayer or partial monolayer ($H_{ml}$) on the substrate. Subsequently, the hydrogen is replaced by a desired metal, which is more noble than atomic hydrogen, in an aqueous solution containing an ion of the metal. The reaction is typically a displacement reaction which may be driven by a galvanic/redox mechanism. Since the deposition or other formation of the hydrogen surface-layer (e.g., a monolayer) is a self-limiting process, deposition of the desired metal also proceeds in a layer-by-layer fashion with atomic layer control. Hence, the process realizes advantages of conventional atomic layer deposition processes: e.g., high conformality and good thickness control.

In certain aspects of this disclosure, the electrochemical deposition of hydrogen in the above process is replaced with a non-electrochemical hydrogen deposition process such as an electroless deposition process or a dry process such as a hydrogen plasma process or a hydrogen cracking process. Even when using a dry hydrogen deposition process, the metal displacement reaction may take place in a wet environment.

In one aspect of the disclosed embodiments, a method of depositing a solid material on a substrate is provided, the method including: (a) forming a layer or a partial layer of hydrogen on a surface of the substrate; and (b) contacting the surface of the substrate with a solution including an ion of a material, whereby ions of the material and the hydrogen react to produce no more than about a monolayer of the material on the surface of the substrate to produce a layer or a partial layer of the material on the surface of the substrate.

In various implementations, the method further includes repeating (a) and (b) on the surface of the substrate. For instance, (a) and (b) may be repeated on the surface of the substrate at least about five times. In some cases, the method further includes repeating (a) and (b) on the surface of the substrate to form a layer of the material having a thickness of between about 0.5 to 5 nanometers.

The layer or partial layer of hydrogen formed in (a) may have a thickness no greater than about a monolayer in many cases. In these or other embodiments, forming the layer or partial layer of hydrogen may include reducing hydrogen on the surface of the substrate. For instance, reducing hydrogen on the surface of the substrate may include electrochemically or electrolessly reducing solvated hydrogen ions. In some cases, reducing hydrogen on the surface of the substrate may be performed by contacting the surface of the substrate with hydrogen species in a plasma. In these or other cases, reducing hydrogen on the surface of the substrate may be performed by contacting the surface of the substrate with hydrogen radicals.

In a particular embodiment, (a) and (b) are each performed in the same solution. In some such cases, (a) may include applying a potential to the substrate, the potential being positive of the equilibrium electrochemical reduction potential of hydrogen gas and aqueous hydrogen ions, and (b) may include removing, reducing, or otherwise altering the potential applied to the substrate.

In a number of implementations, the surface of the substrate may include recessed features, at least some of which have an aspect ratio of at least about three. The surface of the substrate may include electrically conductive regions or may be entirely electrically conductive. Often, the surface of the substrate includes a partially fabricated semiconductor device.

The material formed in (b) may be electrically conductive. In many cases, the material may be a metal. In some such cases, the metal and its ion have an equilibrium electrochemical reduction potential that is more positive than the equilibrium electrochemical reduction potential of hydrogen gas and aqueous hydrogen ions. In these or other cases, the metal may be selected from the group consisting of gold, copper, silver, gemanium, tin, arsenic, bismuth, mercury, palladium, lead, platinum, rhenium, and molybdenum, ruthenium, and combinations thereof. The solution including the ion of the material may be an aqueous solution.

In certain implementations, (a) and (b) are performed in different reaction vessels. In some other cases, (a) and (b) may be performed in a single reaction vessel, with different solutions being piped into the reaction vessel at different times. For instance, (a) may be performed while a first solution is in the reaction vessel, and (b) may be performed while a second solution is in the reaction vessel, the first and second solutions having different compositions. In a particular embodiment, (a) may be performed in an apparatus that includes an anode, electrical contacts configured to apply a cathodic potential to the surface of the substrate, and a vessel configured to contain an electrolyte. In another embodiment, (a) may be performed in an apparatus that includes a chamber having a pedestal configured to support the substrate, and a remote plasma source in communication with the chamber and configured to produce hydrogen radicals. In these or other embodiments, (b) may be performed in an apparatus that includes electrical contacts configured to electrically couple the surface of the substrate to an external circuit, a counter electrode electrically coupled to the external circuit, and a vessel configured to contain the solution including the ion of the material. In various implementations, (a) includes adsorbing the hydrogen on the surface of the substrate.

In another aspect of the embodiments herein, an apparatus is provided, the apparatus including: (a) one or more reaction chambers configured to hold a substrate during reaction; and (b) a controller configured to cause: (i) forming a layer or a partial layer of hydrogen on a surface of the substrate; and (ii) contacting the surface of the substrate with a solution including an ion of a material, whereby ions of the material and the hydrogen react to produce no more than about a monolayer of the material on the surface of the substrate to produce a layer or a partial layer of the material on the surface of the substrate.

In some embodiments (i) and (ii) are performed in the same reaction chamber. In other embodiments, (i) and (ii) are performed in different reaction chambers. In some such embodiments, the controller may be configured to cause transferring the substrate between the reaction chamber in which (i) is performed and the reaction chamber in which (ii) is performed. The apparatus may be configured to maintain the substrate under vacuum or otherwise under a controlled ambient environment during the transfer. The controlled ambient environment may be free or substantially free of oxygen (e.g., containing only trace amounts of oxygen).

The controller may be configured to cause any of the actions, operations, and/or effects described herein. For example, the controller may be configured to cause the substrate to be processed according to any of the methods described herein.

These and other features will be described below with reference to the associated drawings.

BRIEF DESCRIPTION OF THE DRAWINGS

FIG. 1C is a flowchart describing a method of depositing metal using a process that involves cyclically processing the substrate using a dry approach and a wet approach.

FIG. 2 depicts the substrate surface as a layer of hydrogen is formed thereon, followed by displacement of the hydrogen with metal according to various embodiments herein.

DETAILED DESCRIPTION

Figure 1A:
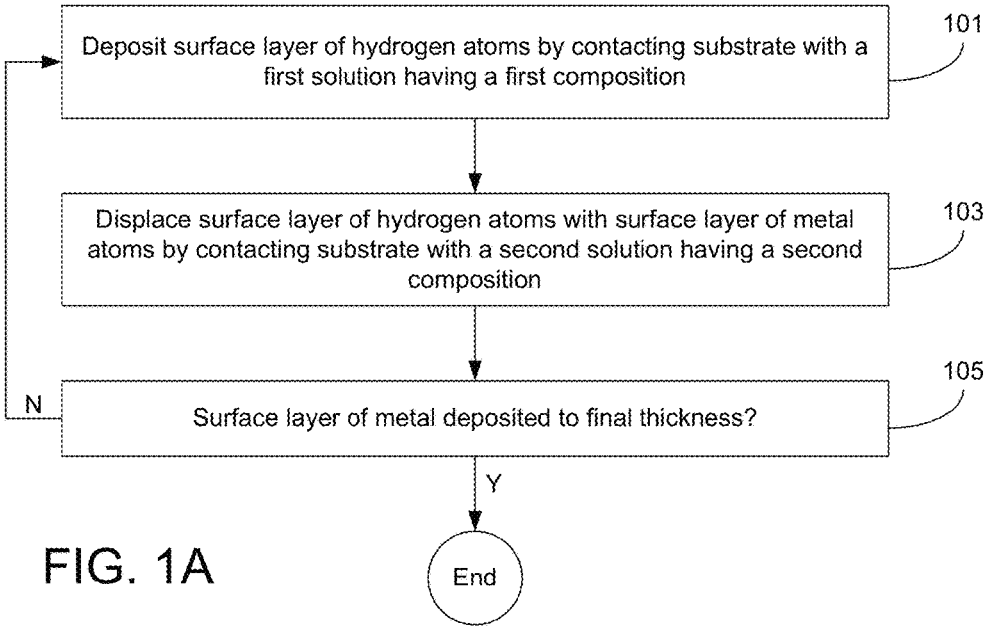
FIG. 1A is a flowchart describing a method of depositing metal using a process that involves cyclically exposing the substrate to two different solutions.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. A wafer or substrate used in the semiconductor device industry typically has a diameter of 200 mm, or 300 mm, or 450 mm. Further, the terms "electrolyte," "plating bath," "bath," and "plating solution" are used interchangeably. The following detailed description assumes the embodiments are implemented on a wafer. However, the embodiments are not so limited. The work piece may be of various shapes, sizes, and materials. In addition to semiconductor wafers, other work pieces that may take advantage of the disclosed embodiments include various articles such as printed circuit boards, magnetic recording media, magnetic recording sensors, mirrors, optical elements, micro-mechanical devices and the like.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

Physical vapor deposition (PVD) is commonly used for depositing metals in back-end processes. However, PVD is unable to deposit thin films with good conformality and thickness control in many embodiments. For example, PVD has limited success with high aspect ratio features at least because the geometry of the feature, combined with the directionality of the PVD process, makes it difficult to deposit the metal conformally along all the surfaces of the feature. Similarly, it can be difficult to achieve a high degree of thickness control with PVD.

The only technology that is able to deposit metal with layer-by-layer atomic-level precision is atomic layer deposition (ALD). However, there are several drawbacks to using ALD to deposit metals. First, ALD employs metalorganic precursors, so the deposited metals always contain carbon contaminants that significantly impact metal conductivity. Maintaining metal conductivity is important to any back-end scaling scheme. Second, the required metalorganic precursors for ALD are expensive.

The disclosed embodiments employ a cyclic process in which each cycle includes (1) forming a partial or complete surface layer of hydrogen atoms, and (2) displacing the surface layer hydrogen atoms with metal atoms. Typically multiple cycles are employed to form a conformal metal layer of desired thickness.

Cyclic electrochemical-based deposition processes have been considered. However, while these processes gradually, cycle-by-cycle, build up a thick layer, they use a contaminating sacrificial material such as lead. Examples of such processes are described in the following references, each incorporated herein by reference in its entirety: (A) Electrochemical atomic layer epitaxy (ECALE), Brian W. Gregory, John L. Stickney, *Journal of Electroanalytical Chemistry and Interfacial Electrochemistry*, Volume 300, Issue 1, Pages 543-561 (1991); (B) Metal monolayer deposition by replacement of metal adlayers on electrode surfaces, S. R. Brankovic, J. X. Wang and R. R. Adzic, *Surf. Sci.*, 474, L173 (2001); (C) Epitaxial Growth of Cu on Au(111) and Ag(111) by Surface Limited Redox Replacement—An Electrochemical and STM Study, L. T. Viyannalage, R. Vasilic and N. Dimitrov, *J. Phys. Chem.,* 111, 4036 (2007); (D) Copper Nanofilm Formation by Electrochemical Atomic Layer Deposition—Ultrahigh-Vacuum Electrochemical and In Situ STM Studies, J. Kim, Y.-G. Kim and J. L. Stickney, J. Electrochem Soc., 154, D260 (2007); and (E) Copper Nano Film Formation Using Electrochemical ALD, C Thambidurai, N Jayaraju, Y G Kim, J L Stickney-ECS Transactions, 11 (7), 103-112 (2007).

In accordance with the present disclosure, depositing hydrogen atoms may be conducted using any of various processes. In each case, the hydrogen atoms are deposited in a surface limited fashion. For example, the hydrogen atoms may be adsorbed onto the surface of the substrate; however this is not always required. Further, the hydrogen atoms form a monolayer or partial monolayer on the substrate surface. This affords the desired atomic-level thickness control.

Various implementations are envisioned. Some deposition processes employ a liquid as the source of hydrogen atoms and a liquid as the source of metal ions. Other processes employ a gas or plasma as the source of hydrogen atoms and a liquid as the source of metal ions. In certain embodiments, the source of metal ions is an aqueous solution. In liquid based processes, the source of hydrogen atoms may be aqueous or non-aqueous. Liquid-based processes may employ one solution or two solutions. Each of these will be discussed in turn.

Cyclic Nature of the Deposition

Embodiments described herein involve deposition by multiple self-limited cycles. The disclosed techniques deposit thin layers of material using sequential self-limiting reactions. Typically, a cycle includes operations to (1) deliver at least hydrogen to the substrate surface in a self-limiting manner, and then (2) react the hydrogen on the surface with one or more metal ions to form a partial layer of film. (The full film is prepared after multiple cycles.)

Unlike a chemical vapor deposition process, the cyclic processes disclosed herein use surface-mediated deposition reactions to deposit films on a layer-by-layer basis. In one example, a substrate surface that includes a population of surface active sites is exposed to hydrogen under conditions that cause hydrogen atoms to be adsorbed onto (or otherwise become attached to) the substrate surface. After this, the substrate surface is removed from the solution or other environment (e.g., gas, plasma, etc.) that produced the surface layer of hydrogen. The substrate surface is then exposed to a metal ion-containing solution so that some of the metal ions react with the hydrogen on the surface. In some processes, the metal ions react immediately with the hydrogen. Thereafter, the substrate surface is removed from contact with the metal ion-containing solution. Additional cycles may be used to build film thickness.

As mentioned, certain embodiments pertain to liquid phase ALD-like processes that build up a conductive layer over multiple cycles, each involving reduction of hydrogen ions to form a hydrogen monolayer on a substrate followed by reaction/displacement of the adsorbed hydrogen with metal ions to produce a metal monolayer. Unlike ALD, certain embodiments herein use at least one step that includes wet processing.

In certain embodiments, a monolayer or sub-monoloyer of hydrogen is first electrochemically deposited on a conductive substrate from a hydrogen ion-containing solution. The hydrogen may also be provided using dry techniques such as vapor deposition, which may or may not involve plasma. After the hydrogen monolayer is formed, it is contacted with (e.g., immersed in) a solution containing ions of the metal to be deposited. If the metal to be deposited is more noble than atomic hydrogen, then a galvanic displacement reaction will occur. Hydrogen on the substrate surface will oxidize to $H_2$, and the metal ion will reduce to zero valence metal, displacing the hydrogen on the substrate surface.

Two Solution Approach:

A two solution approach is presented in the flowchart shown in FIG. 1A. In this case, the method starts with operation 101, where a surface layer of hydrogen atoms is deposited by contacting the substrate with a first solution having a first composition. This operation may be carried out as an electrolytic step or an electroless step. In electrolytic versions of operation 101, a cathodic potential is applied to the substrate while the substrate is contacted with the first solution. In electroless versions of operation 101, no potential is applied to the substrate, but the first solution contains a reducing agent and/or other appropriate components for supporting electroless deposition. Examples of reducing agents for electroless deposition include hydrazine and sodium hypophosphite. Electroless deposition of the hydrogen surface layer is particularly beneficial in cases where selectivity is desired in the deposition. For example, in various embodiments the reducing agent is catalytic only on electrically conductive portions of the substrate surface. As such, this technique can be used to selectively deposit the hydrogen surface layer (and therefore the metal surface layer) only on electrically conductive portions of the substrate, while leaving electrically insulating or otherwise electrically non-conductive regions uncoated. The hydrogen on the surface may exist as atomic hydrogen, a metal hydride, etc., and may be a complete layer or a partial layer.

Next, the method continues with operation 103, where the surface layer of hydrogen atoms is displaced with a surface layer of metal atoms by contacting the substrate with a second solution having a second composition. This operation may be carried out as an electroless step, and the reaction may be a displacement reaction. The second composition differs from the first composition. In various embodiments, the first composition does not contain any metal ions, particularly no ions of the metal to be deposited. By contrast, the second composition contains metal ions of the metal to be deposited.

Then, at operation 105 it is determined whether the surface layer of metal has been deposited to its final thickness. This determination may be accomplished by various techniques, any of which may involve either measuring the thickness of the layer (optionally in situ) or simply maintaining a count of deposition cycles and comparing the current count to a set final count value. Where the surface layer of metal has not yet reached its final thickness in operation 105, the method is repeated starting at operation 101. Where the surface layer of metal has reached its final thickness in operation 105, the method is complete. In many cases, several iterations of operations 101-105 are performed to gradually build up the surface layer of metal to its desired final thickness. This layer-by-layer cyclic process provides atomic-level control over the thickness of the deposited metal.

Figure 1B:
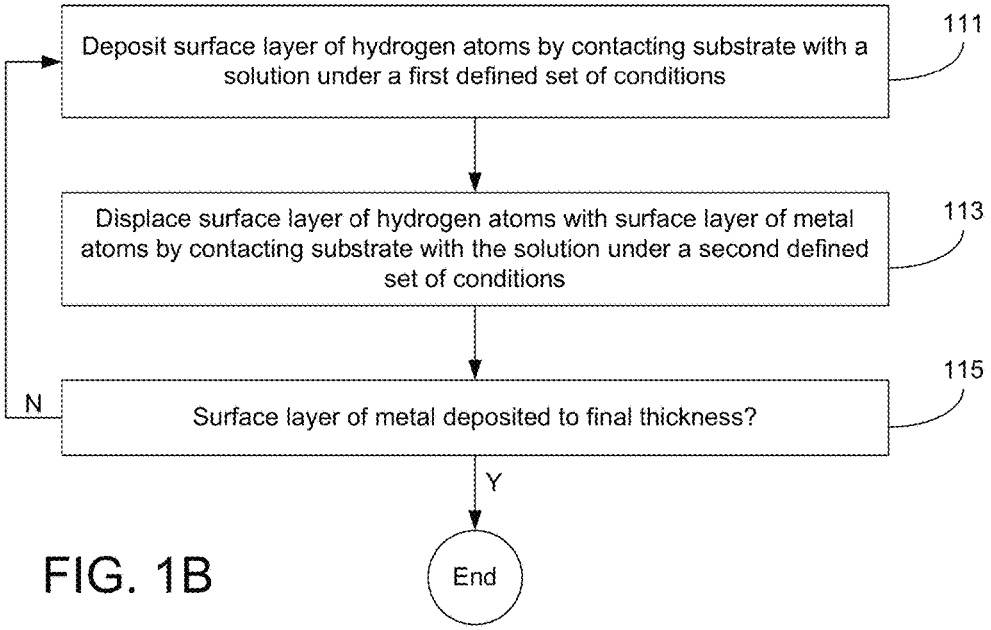
FIG. 1B is a flowchart describing a method of depositing metal using a process that involves cyclically exposing the substrate to two different sets of conditions while the substrate is in a solution.

One Solution Approach:

A one solution approach is presented in the flowchart shown in FIG. 1B. In this embodiment, the method starts with operation 111, where a surface layer of hydrogen atoms is deposited by contacting the substrate with a solution under a first defined set of conditions. In some embodiments, the first conditions include exposing the substrate to an electrical potential that drives hydrogen ions onto the substrate surface where they are adsorbed, reduced, or otherwise provided on the substrate as a layer or partial layer. The hydrogen on the surface may exist as atomic hydrogen, a metal hydride, etc.

In various embodiments of the one solution approach, the hydrogen demonstrates underpotential deposition on the substrate surface. Underpotential deposition occurs when a cation reduces at a more positive potential than its standard equilibrium potential. Whether or not a metal will exhibit underpotential deposition on a substrate is strongly dependent upon the surface of the substrate. Hydrogen exhibits underpotential deposition on various metal surfaces including, but not limited to, noble metal surfaces such as ruthenium, platinum, rhodium, palladium, silver, osmium, iridium, gold, copper, etc. In order to achieve such underpotential deposition of hydrogen, the potential applied to the substrate may be more anodic (e.g., more positive/less negative) than the standard $H^+(aq)/H_2$ equilibrium reduction potential. The underpotential deposition helps ensure that operation 111 favors deposition of hydrogen, rather than the metal that is also in the solution.

Next, the method continues with operation 113, where the surface layer of hydrogen atoms is displaced by a surface layer of metal atoms by continuing to contact the substrate with the solution under a second defined set of conditions. The second defined set of conditions is different from the first defined set of conditions. The solution used in operation 113 may be the same or similar solution used in operation 111, and it may have the same or substantially the same composition. In some cases, the exact same solution may be used for both operations, without any changes made to the solution between operations 111 and 113. As used herein with regard to this operation, "substantially the same composition" means that the composition of the solution has not been altered, except to the small degree that contacting the substrate with the solution may itself change the composition of the solution.

In certain embodiments, the second conditions include removing, reducing in magnitude, or otherwise revising the cathodic electrical potential to favor the displacement reaction in which metal atoms displace hydrogen on the substrate surface (e.g., as opposed to adsorption or other deposition of the hydrogen on the substrate surface). As mentioned above, during operation 113 the substrate surface may remain in contact with the single solution that was used for forming the layer of hydrogen.

Next, at operation 115 it is determined whether the surface layer of metal has been deposited to its final thickness. As with the two solution approach, this determination may be accomplished by various techniques, any of which may involve either measuring the thickness of the layer or simply maintaining a count. Where the surface layer of metal has not yet reached its final thickness in operation 115, the method is repeated starting at operation 111. Where the surface layer of metal has reached its final thickness in operation 115, the method is complete. In many cases, several iterations of operations 111-115 are performed to gradually build up the surface layer of metal to its desired final thickness. This layer-by-layer cyclic process may provide atomic-level control over the thickness of the deposited metal.

Where a one solution approach is used as described in FIG. 1B, the solution may have particular properties. In certain embodiments, the single solution contains a limited amount of metal ion so that during operation 111, metal is not significantly electrochemically deposited. For instance, the metal ion concentration may be controlled to ensure that during operation 111, the hydrogen is deposited at a substantially higher rate compared to the metal. In various embodiments, the metal ion concentration may be sufficiently low such that during operation 111 (deposition of the surface layer of hydrogen), the rate of hydrogen deposition is at least ten times the rate of metal deposition (as measured by the number of hydrogen and metal atoms (or relatedly, the number of monolayers of such species) that deposit on the substrate over time). Appropriate conditions are discussed further, below.

In this way, the kinetics of the two reactions are controlled by the solution composition in conjunction with the first and second conditions so as to (a) facilitate monolayer deposition of hydrogen during the first operation, and (b) favor metal displacement during the second operation.

In certain embodiments, the difference in reversible potentials between hydrogen and the metal to be deposited is less than about 70 mV. Examples of suitable metals include tin, silver, lead, and germanium.

Dry Hydrogen Deposition Approach:

A dry hydrogen deposition approach is presented in the flowchart shown in FIG. 1C. In this embodiment, the method begins with operation 121, where the substrate is contacted with hydrogen in a non-liquid form. The hydrogen may be provided in a reactive form that promotes formation of the layer or partial layer of hydrogen on the substrate surface. In some examples, the hydrogen is provided as a plasma (e.g., from a direct plasma source, or from a remote plasma source). In some cases, the hydrogen is provided via a hydrogen cracking process. In some embodiments, the hydrogen is provided as hydrogen radicals that may be produced by various techniques such as by using a remote plasma. Example apparatus that may be used to provide a remote plasma include products in the Gamma® Product Family, available from Lam Research Corporation of Fremont, Calif. In various embodiments, the hydrogen on the surface may exist as atomic hydrogen, a metal hydride, etc., and may be a complete layer or a partial layer.

Next, the method continues with operation 123, where the surface layer of hydrogen atoms is displaced with a surface layer of metal atoms by contacting the substrate with a solution. The solution includes ions of the metal to be deposited. Operation 123 of FIG. 1C may be similar or identical to operation 103 of FIG. 1A. Any details provided in relation to operation 103 may also apply to operation 123.

Then, at operation 125 it is determined whether the surface layer of metal has been deposited to its final thickness. This determination may be accomplished by various techniques, any of which may involve either measuring the thickness of the layer (optionally in situ) or simply maintaining a count of deposition cycles and comparing the current count to a set final count value. Where the surface layer of metal has not yet reached its final thickness in operation 125, the method is repeated starting at operation 121. Where the surface layer of metal has reached its final thickness in operation 125, the method is complete. In many cases, several iterations of operations 121-125 are performed to gradually build up the surface layer of metal to its desired final thickness. This layer-by-layer cyclic process provides atomic-level control over the thickness of the deposited metal.

Mechanism of Hydrogen Deposition:

During the first phase of the cyclic deposition reaction, hydrogen attaches to the surface of the substrate in any of various manners. In certain embodiments, the hydrogen on surface of the substrate is atomic hydrogen. In some embodiments, the hydrogen is bonded (e.g., covalently bonded) to exposed atoms on the substrate surface. Generally, the hydrogen in the surface layer is a chemically reduced form of hydrogen. If, for example, the hydrogen source is solvated positive hydrogen ions, the surface-attached form of hydrogen is chemically reduced from the ionic form. In its reduced state, the hydrogen can be oxidized via a subsequent displacement reaction with a more noble metal ion.

During the first phase of the cycle, hydrogen is deposited on the substrate in a surface-limited fashion. It may be adsorbed, but this is not necessarily the case. As mentioned, the hydrogen may bond with the exposed atoms of the substrate surface. In such cases, the hydrogen may have characteristics of a hydride such as a metal hydride. Information about the characteristics of surface-bound hydrogen are presented in Surface and Subsurface Hydrogen: Adsorption Properties on Transition Metals and Near-Surface Alloys, J. Greeley and M. Mavrikakis, J. Phys Chem B, vol. 109, pages 3460-71 (2005), which is incorporated herein by reference in its entirety.

The deposited hydrogen may form a monolayer, in which all or nearly all available sites on the substrate surface are occupied by hydrogen, or a sub-monolayer in which only a fraction of the available sites are occupied by hydrogen. In certain embodiments, the surface layer of hydrogen includes more than a full monolayer of hydrogen; e.g., up to about 1.5 times the amount of hydrogen in a monolayer. Sub-monolayers may include about 0.5 or more (but less than 1) times the amount of hydrogen in a monolayer.

Conditions for Depositing Hydrogen Under Two Solution Approach:

In two-solution embodiments such as the one described in relation to FIG. 1A, the hydrogen source for forming the surface layer of hydrogen may be hydrogen ions in an aqueous solution. This aqueous solution is the first solution referred to in operation 101 of FIG. 1A. In electrolytic embodiments, the first solution may be particularly simple. It may be essentially water, acid, or base. In certain embodiments, it includes little (if any) cations other than hydrogen ions. For example, it may contain no more than about 100 ppm of metals more noble than hydrogen. In certain embodiments, the first solution has a pH of between about 1 and 12, or between about 1 and 7. In certain embodiments, it has a pH between about 1 and 4. In certain embodiments, the first solution has no organic additives of the type normally employed in metal electroplating (e.g., suppressors, accelerators, and/or levelers used to promote bottom-up fill in semiconductor fabrication). In certain embodiments, the first solution is degassed prior to contacting the substrate with the first solution in order to eliminate dissolved oxygen. Such oxygen could participate in an undesired oxygen reduction reaction as a side reaction during the metal deposition reaction.

During deposition of hydrogen, the substrate surface is made electrically cathodic. In some embodiments, the electrical potential is sufficiently negative to evolve some hydrogen gas. In certain embodiments, the applied potential is negative of the $H^+(aq)/H_2$ equilibrium reduction potential. While the applied potential depends on a variety of factors including the composition and condition of the substrate surface, temperature, and the solution composition (including pH), in certain embodiments, the applied potential is between about −0.1 and −0.6 V versus the standard $H^+(aq)/H_2$ equilibrium reduction potential in an acidic solution (pH<2). In less acidic solutions, the applied potential may be shifted more cathodic.

In certain embodiments, the temperature of the substrate and/or electrolyte during hydrogen deposition is between about 10° C. and 80° C. In certain embodiments, the temperature of the substrate and/or electrolyte during hydrogen deposition is between about 20° C. and 40° C.

The substrate may be contacted with the first solution by immersing the substrate in the first solution. The duration over which the substrate is exposed to the first solution in each cycle may be between about 5-120 seconds, or between about 10-60 seconds. In some cases, the duration is sufficiently long to achieve a saturated monolayer of hydrogen on the substrate surface. In other cases, a shorter duration may be used to achieve a lesser degree of hydrogen saturation. In some embodiments, the duration is sufficiently long to achieve at least about 75% saturation, or at least about 90% saturation.

Conditions for Depositing Metal Under Two Solution Approach or Dry Hydrogen Approach:

In two-solution embodiments such as the one described in relation to FIG. 1A, the metal source for forming the surface layer of metal may be metal ions in an aqueous solution. This aqueous solution is the second solution referred to in operation 103 of FIG. 1A. As with the first solution that acts as a hydrogen source, the second solution that acts as a metal source may be a simple solution. For example, it may free of (or essentially free of) organic additives of the type normally employed in metal electroplating (e.g., the previously mentioned suppressors, accelerators, and/or levelers). In certain embodiments, the second solution contains essentially no metal ions other than those to be deposited. In certain embodiments, the second solution contains essentially no metal ions more noble than hydrogen, other than those to be deposited. The concentration of metal ions can be as high as the metal's solubility limit. The second solution may include ligands that stabilize the metal ions in certain implementations (e.g., ligands such as citrate, tartrate, or other ligands commonly used in metal plating). In some embodiments, the pH of the second solution may be between about 1-10, for example between about 1-7. The second solution may be degassed prior to contact with the substrate, for example to eliminate dissolved oxygen.

In some embodiments, the process produces an alloy or other combination of two or more metals. In such cases, an alloy of different metals can be deposited by using two or more varieties of metal ions in the solution. The composition of the deposited alloy may depend on a number of factors including the relative concentrations and reduction potentials of the different metal ions in the second solution.

In some embodiments, no electrical potential is applied to the substrate during metal deposition.

In certain embodiments, the temperature of the substrate and/or electrolyte during metal deposition is between about 10° C. and 80° C. In certain embodiments, the temperature of the substrate and/or electrolyte during metal deposition is between about 20° C. and 40° C.

The duration over which the substrate is exposed to the second solution in each cycle may be sufficiently long to displace all or substantially all of the hydrogen on the surface of the substrate with metal. In some embodiments, the duration may be sufficiently long to displace at least about 90%, or at least about 95%, of the hydrogen with metal. In some cases, this may occur over a duration between about 0.1-30 seconds, for example between about 0.1-10 seconds, or between about 0.1-2 seconds.

Conditions for Depositing Hydrogen and Metal Using One Solution Approach:

As described above, where a one solution approach is used, a single solution is used both to deposit the hydrogen layer and to displace the hydrogen layer with a metal layer.

Two different defined sets of conditions are cycled with one another to repeatedly carry out these tasks. In such cases, the solution is an aqueous solution that includes water, acid or base, and metal ions of the metal to be deposited. In certain cases the solution may have a maximum concentration of metal ions in order to discourage deposition of metal ions when deposition of hydrogen ions is desired. In some embodiments, the maximum concentration of metal ions in the solution for the one solution approach may be in the micromolar range. In some such embodiments, this metal ion concentration may be between about 10 μM-1 mM, for example between about 10-500 or between about 100-500 μM.

The solution may be free of organic additives commonly used in electroplating such as suppressors, accelerators, and levelers. In some cases, the pH of the solution may be between about 1-12. In certain embodiments, it has a pH between about 1-7, or between about 1-4. The solution may be degassed prior to contacting the substrate in order to eliminate dissolved oxygen, for example. The solution and/or substrate may be maintained at a temperature between about 10° C. and 80° C., in some cases between about 20° C. and 40° C.

The first defined set of conditions is tailored to achieve hydrogen deposition on the substrate surface, while the second defined set of conditions is tailored to achieve metal deposition on the substrate surface (e.g., displacing the hydrogen with metal). The first defined set of conditions varies from the second defined set of conditions with respect to at least one processing condition. In various embodiments, the potential and/or current applied to the substrate is different between the first and second defined sets of conditions. For instance, the applied anodic potential for the first defined set of conditions may be positive of the $H^+(aq)/H_2$ equilibrium reduction potential. While this applied potential depends on a variety of factors including the composition and condition of the substrate surface, temperature, and the solution composition (including pH), in certain embodiments, the applied potential for the first defined set of conditions is between about 0.1 and 0.6 V more positive versus the standard $H^+(aq)/H_2$ equilibrium reduction potential in an acidic solution (pH<2). By contrast, for the second defined set of conditions, the applied potential may be removed, reduced in magnitude, made less positive/more negative, or otherwise revised compared to the applied cathodic potential used for the first defined set of conditions. The difference between the applied potential for the first and second defined sets of conditions may be at least about 0.05 V, or at least about 0.1 V. In various cases, the difference in reversible potentials between hydrogen and the metal to be deposited is less than about 70 mV.

The first defined set of conditions and second defined set of conditions are cycled with one another to gradually build up the thickness of the metal film. During each cycle, the substrate may be exposed to the first defined set of conditions for a duration that is at least about 1 ms, or at least about 10 ms, or at least about 100 ms. In these or other cases, this duration may be about 5 seconds or shorter, for example about 1 second or shorter. The duration may be sufficiently long to achieve saturation of the substrate surface (e.g., with mostly hydrogen), or at least about 75% saturation, or at least about 90% saturation. The substrate may be exposed to the second defined set of conditions for a duration that is at least about 1 minute, at least about 5 minutes, at least about 10 minutes, at least about 20 minutes, or at least about 30 minutes. In these or other cases, this duration may be about 1 hour or less, for example about 30 minutes or less, or about 20 minutes or less. This duration may be sufficiently long to displace most or all of the hydrogen (e.g., at least about 90% or at least about 95%) with metal. In some cases, the duration for which the substrate is exposed to the first defined set of conditions during each cycle is longer than the duration for which the substrate is exposed to the second defined set of conditions during each cycle. In some other embodiments, the duration for which the substrate is exposed to the first defined set of conditions during each cycle is shorter than the duration for which the substrate is exposed to the second defined set of conditions during each cycle. In some other embodiments, the relevant durations may be equal.

Figure 4:
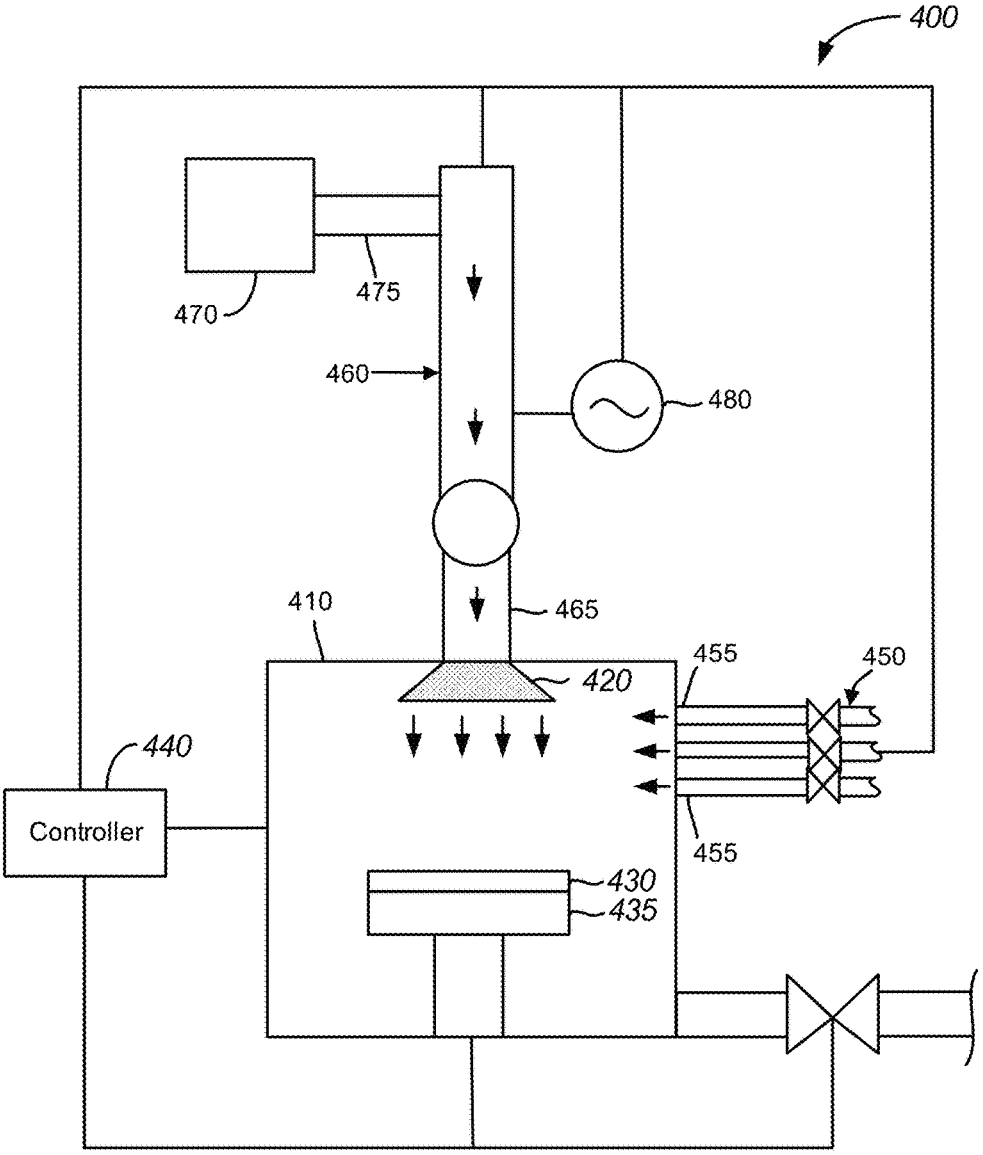
FIG. 4 depicts an apparatus that can be used for vapor deposition according to certain embodiments herein.

Conditions for Depositing Hydrogen Using Dry Hydrogen Approach:

Various dry approaches may be used to form the layer of hydrogen. FIG. 4, further discussed below, provides one example of a remote plasma apparatus that may be used to form the layer of hydrogen on the substrate surface. A number of different techniques may be used. In some cases, the hydrogen is provided via plasma. The plasma may be generated directly in the chamber in which the substrate is located, or it may be generated at a remote location and fed into the chamber in which the substrate is located. In many cases, the plasma is generated from hydrogen or a mixture of hydrogen and inert gas. However, in some cases the plasma may be generated from a hydrogen-containing gas that includes species other than hydrogen/inert gas. Examples of such gases include, but are not limited to, water ($H_2O$), methane ($CH_4$), and ethylene ($C_2H_4$).

In some cases, the hydrogen is provided through a hydrogen cracking process. In one particular example, the hydrogen is provided as hydrogen radicals. The hydrogen radicals can be produced by various means, including, e.g., remote plasma techniques. The substrate may be exposed to the hydrogen source for a sufficient duration to achieve saturation or near saturation, as described elsewhere herein.

Example Benefits:

The disclosed embodiments may overcome the above-mentioned drawbacks of a conventional dry ALD processes. For example, the use of hydrogen as a reactant provides a very pure deposited metal. To the extent that hydrogen remains in the layer after the metal is deposited, it can be easily removed by annealing or otherwise. Prior dry ALD processes for depositing metal resulted in incorporation of substantial impurities due to the metalorganic precursors required in such processes. Such impurities often typically include carbon, which deleteriously affects the conductivity of the deposited metal. Similarly, prior wet chemical methods of depositing films used lead or a similar material as a sacrificial layer. Such materials are very difficult, if not impossible, to remove from the desired metal layer. The disclosed metal deposition processes provide high purity and high conductivity metal deposits since the precursors used are hydrogen ions and ions of the desired metal. In various embodiments, the reactants contain no ions of metals other than the desired metal or metals. Both hydrogen and the desired metal may be provided in aqueous solutions, in some cases.

Because there may be no side reactions, the metal growth can be epitaxial or nearly epitaxial.

From a cost perspective, the disclosed processes are also significantly cheaper than traditional ALD processes that requires expensive metalorganic precursors and high vacuum chambers.

Applications:

Various applications are contemplated. Among these are the formation of thin conductive lines, such as those used as interconnect lines in back-end processes. Another application is the formation of capping layers on conductive lines. Such layers may help reduce electromigration of conductive metals. Examples of capping layers are described in, for example, U.S. Pat. No. 8,753,978 issued Jun. 17, 2014, and US Patent Application Publication No US 2013-0323930, filed May 29, 2012, both of which are incorporated herein by reference in their entireties. Yet another application is the formation of electrodes such as noble metal electrodes in memory devices such as, e.g., magnetoresistive random-access memory and phase change random-access memory (PCRAM).

Substrates:

In various embodiments, the substrate on which the metal is deposited comprises a partially fabricated semiconductor device. The partially fabricated device may have one or more features such as recessed features on which the metal layer is conformally deposited, cycle-by-cycle. Examples of features include trenches, vias, gaps, etc. In certain embodiments, one or more such features on the substrate surface have average widths or openings of about 100 nanometers or less. In certain embodiments, one or more features on the substrate surface have aspect ratios of about 5 or greater. The aspect ratio is a comparison between the width of the feature and the depth of the feature. The aspect ratio is calculated as the depth of the feature divided by the average width of the opening for the feature (e.g., depth/width). In all such cases, the deposition processes described herein provide films that are substantially conformal. A substantially conformal film is typically one that closely follows the contours of features of the underlying substrate such that thickness of the substantially conformal film does not vary by more than about 20% between the thickest and thinnest portion of the layer.

EXAMPLES

FIG. 2 illustrates one example of a two-step cycle for depositing metal according to various embodiments herein. First a substrate is provided (represented by "S"). Next, hydrogen (represented by "H") is provided to the substrate to form a surface layer of hydrogen atoms. In this example, the hydrogen is provided to the substrate in the form of hydrogen ions. The hydrogen adsorbs onto the substrate to form an adsorbed layer. Next, metal ions (represented by "M" and having a charge of "+n") are provided in a solution that contacts the substrate such that the hydrogen atoms are displaced with metal atoms on the substrate surface. The double headed arrow indicates that the hydrogen deposition and metal deposition steps are cycled with one another to gradually build up metal thickness in a layer-by-layer manner.

Figure 3A:
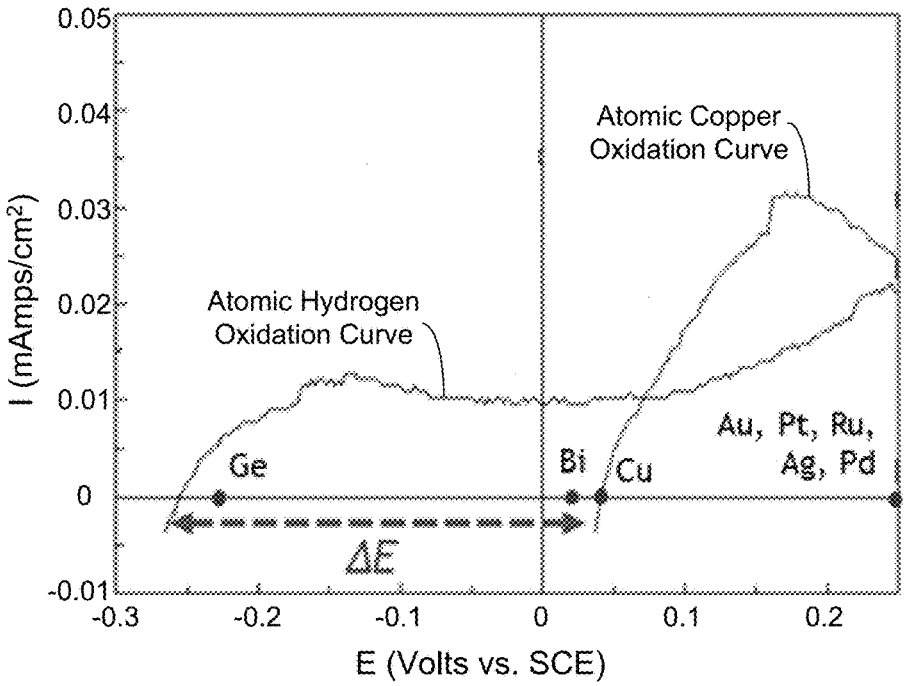
FIG. 3A presents current potential curves for oxidation of hydrogen and copper.

FIG. 3A illustrates current-potential curves for oxidation of atomic hydrogen and oxidation of atomic copper. The hydrogen exhibits a redox potential of about −0.25V vs. a saturated calomel electrode (SCE). Also shown along the x-axis are the redox potentials for germanium, bismuth, gold, platinum, ruthenium, silver, and palladium. Any metal that is more noble than hydrogen can be deposited by atomic hydrogen using the techniques described herein.

Figure 3B:
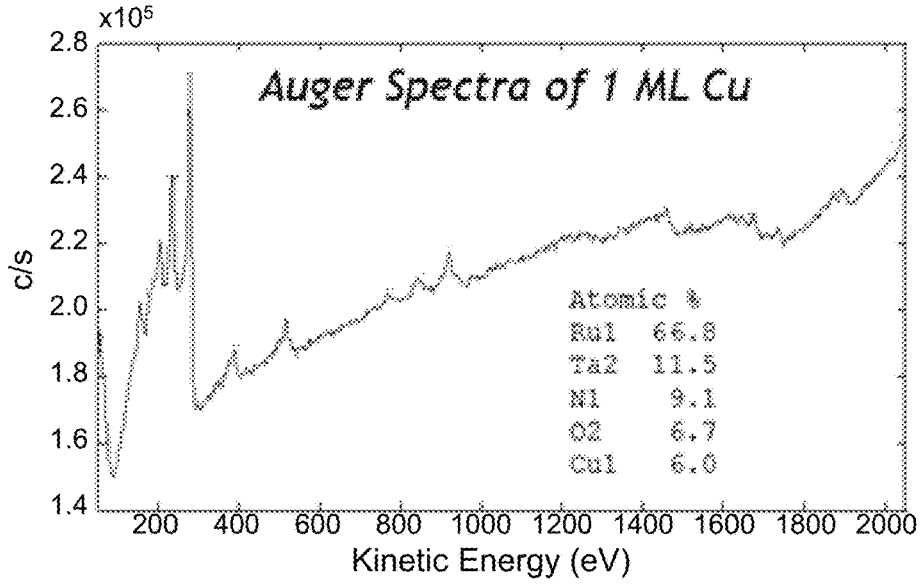
FIG. 3B illustrates results of an Auger Spectra, the results indicating that a layer of copper was successfully deposited on a ruthenium substrate.

FIG. 3B provides results related to an Auger electron spectroscopy evaluation performed on a monolayer of copper that was deposited on a ruthenium substrate using an electrochemically deposited hydrogen technique described herein. These results provide proof-of-concept that the described techniques can be used to electrochemically deposit metal as described herein.

Apparatus

The methods described herein may be performed by any suitable apparatus. A suitable apparatus includes hardware for accomplishing the process operations and a system controller having instructions for controlling process operations in accordance with the present embodiments. For example, in some embodiments, the hardware may include one or more process stations included in a process tool.

In various embodiments, the apparatus includes a flowable system (with or without recirculation) to expose the wafer to different solutions for cyclic process. The different solutions may be provided in separate vessels, or in a single vessel that receives different solutions over time. The apparatus may need to be operated in a controlled ambient environment to eliminate or reduce the dissolved oxygen concentration. For combined dry/wet processes, the apparatus may include a clustered transfer chamber to transfer the wafer from a hydrogen pre-treatment chamber to a wet processing module under controlled ambient conditions. In cases where two solutions are used in different vessels, a similar clustered transfer chamber may be provided to transfer the wafer between the vessels under controlled ambient conditions.

For dry sources of hydrogen, various apparatus may be used. Examples include remote plasma sources such as those described in U.S. Pat. No. 9,234,276 filed May 31, 2013, and U.S. Pat. No. 9,371,579 filed Oct. 24, 2013, both incorporated herein by reference in their entireties.

FIG. 4 illustrates a schematic diagram of a remote plasma apparatus that may be used as a dry source of hydrogen according to certain embodiments. The apparatus 400 includes a reaction chamber 410, a remote plasma source 460, a precursor gas delivery source 450, and a showerhead assembly 420. Inside the reaction chamber 410, a substrate 430 rests on a stage or pedestal 435. In some embodiments, the pedestal 435 can be fitted with a heating/cooling element. A controller 440 may be connected to the components of the apparatus 400 to control the operation of the apparatus 400. For example, the controller 440 may contain instructions for controlling process conditions for the operations of the apparatus 400, such as the temperature process conditions and/or the pressure process conditions.

During operation, gases or gas mixtures are introduced into the reaction chamber 410 via one or more gas inlets coupled to the reaction chamber 410. In some embodiments, a plurality of gas inlets is coupled to the reaction chamber 410. A precursor gas delivery source 450 may include a plurality of first gas inlets 455 coupled to the reaction chamber 410 for the delivery of precursor gases. Each of the plurality of first gas inlets 455 may enable multiple precursor gases to be co-flowed together into the reaction chamber 410, which can occur simultaneously or sequentially. A second gas inlet 465 may be coupled to the reaction chamber 410 via the showerhead assembly 420 and connected to a remote plasma source 460. The second gas inlet 465 may be connected to the showerhead assembly 420 for the delivery of radical species. The second gas inlet 465 may be connected to a vessel 470 which provides a source gas for the radical species. In embodiments including remote plasma configurations, the delivery lines for the precursors and the radical species generated in the remote plasma source 460 are separated. Hence, the precursors and the radical species do not substantially interact before reaching the substrate 430.

One or more radical species may be generated in the remote plasma source 460 and configured to enter the reaction chamber 410 via the second gas inlet 465. Any type of plasma source may be used in the remote plasma source 460 to create the radical species. This includes, but is not limited to, capacitively coupled plasmas, microwave plasmas, DC plasmas, inductively coupled plasmas, and laser-created plasmas. An example of a capacitively coupled plasma can be a radio-frequency (RF) plasma. A high-frequency plasma can be configured to operate at 13.56 MHz or higher. An example of such a remote plasma source 460 can be the GAMMA®, manufactured by Lam Research Corporation of Fremont, Calif. Another example of such a RF remote plasma source 460 can be the Aston®, manufactured by MKS Instruments of Wilmington, Mass., which can be operated at 440 kHz and can be provided as a subunit bolted onto a larger apparatus for processing one or more substrates in parallel. In some embodiments, a microwave plasma can be used as the remote plasma source 460, such as the Astex®, also manufactured by MKS Instruments. A microwave plasma can be configured to operate at a frequency of 2.45 GHz.

The remote plasma source 460 may include a plasma dome or other shape to form a volume for delivering the source gas from the vessel 450. Examples of remote plasma sources may be described in U.S. Pat. Nos. 8,084,339, 8,217,513, U.S. patent application Ser. No. 12/533,960, U.S. patent application Ser. No. 11/616,324, U.S. patent application Ser. No. 13/493,655, U.S. patent application Ser. No. 12/062,052, and U.S. patent application Ser. No. 12/209,526, each of which is incorporated herein by reference in its entirety for all purposes. In some embodiments, the remote plasma source 460 may include an inlet 475 connected to the vessel 470 with a plurality of holes configured to distribute the source gas into the internal volume of the remote plasma source 460.

When the source gas enters the remote plasma source 460, a plasma may be generated using the radio-frequency (RF) coils (not shown), which may be connected to an RF source 480 via a matching network. The plasma may generate radical species, such as hydrogen radicals, from a hydrogen source gas that flows towards the showerhead assembly 420. The radical species may flow through a plurality of holes in the showerhead assembly 420 from the second gas inlet 465 to distribute the radical species into the reaction chamber 410. At the same time, precursor gases may be distributed from the first gas inlets 455 into the reaction chamber 410 to mix with the radical species. The precursor gases may be flowed into the reaction chamber 410 at a controlled flow rate. Reactions with the precursor gases and the radical species may take place in the reaction chamber 410 above and adjacent to the substrate 430.

The radical species formed in the remote plasma source 460 is carried in the gas phase into the reaction chamber 410 toward the substrate 430. The remote plasma source 460 may be substantially perpendicular to the substrate 430 so as to direct the radical species in a substantially transverse direction to the surface of the substrate 430 from the showerhead assembly 420. It is understood, however, that the remote plasma source 460 may be oriented in any number of directions relative to the surface of the substrate 430. The distance between the remote plasma source 460 and the substrate 430 can be configured to provide mild reactive conditions such that the ionized species generated in the remote plasma source 460 are substantially neutralized, but at least some radical species in substantially low energy states remain in the environment adjacent to the substrate 430. Such low energy state radical species are not recombined to form stable compounds. The distance between the remote plasma source 460 and the substrate 430 can be a function of the aggressiveness of the plasma (e.g., adjusting the RF power level), the density of gas in the plasma (e.g., if there's a high concentration of hydrogen atoms, a significant fraction of them may recombine to form $H_2$ before reaching the reaction chamber 410), and other factors. In some embodiments, the distance between the remote plasma source 460 and the reaction chamber 410 can be greater than about 10 cm, such as between about 10 cm and 50 cm. Also, for some of the same or similar reasons, the distance between the showerhead assembly 420 and the first gas inlets 455 may be greater than about 5 cm, such as between about 5 cm and about 20 cm.

The controller 440 may contain instructions for controlling process conditions and operations in accordance with the present embodiments for the apparatus 400. The controller 440 will typically include one or more memory devices and one or more processors. The processor may include a CPU or computer, analog and/or digital input/output connections, stepper motor controller boards, etc. Instructions for implementing appropriate control operations are executed on the processor. These instructions may be stored on the memory devices associated with the controller 440 or they may be provided over a network. Machine-readable media containing instructions for controlling process operations in accordance with the present embodiments may be communicatively coupled to the controller 440. In various embodiments, the controller may be a system controller, as discussed further below.

The apparatus shown in FIG. 4 may be used to provide dry hydrogen to the substrate according to the method described in FIG. 1C, for example. Such an apparatus may be incorporated into a multi-tool processing apparatus, or it may be provided as a standalone unit. Multi-tool processing apparatus are particularly useful, as they can transfer the substrate between different modules/chambers while maintaining a controlled atmosphere around the substrate, thereby minimizing contamination and damage.

Figure 5:
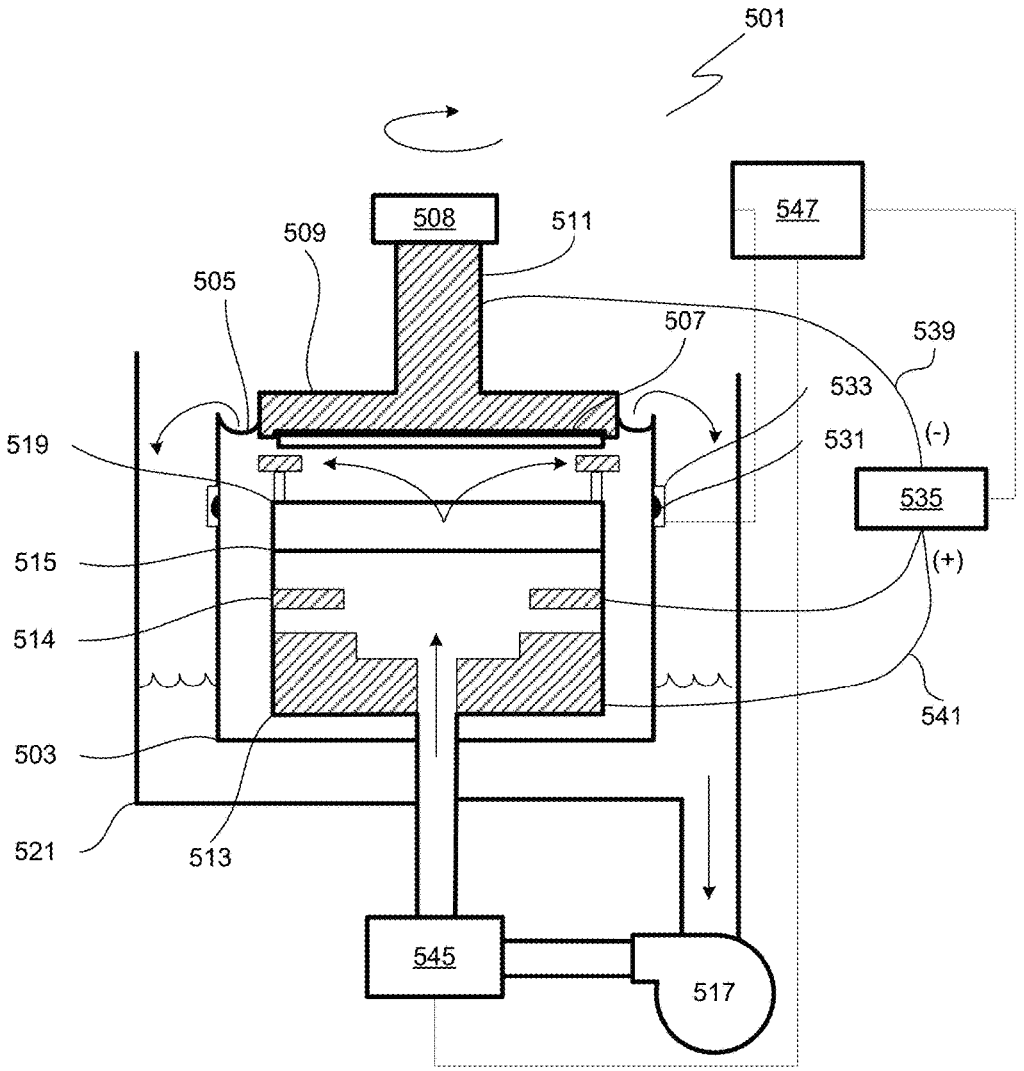
FIG. 5 shows an apparatus that can be used for plating (e.g., electroplating and/or electroless plating) according to various embodiments herein.

FIG. 5 presents an example of an electroplating cell in which one or more steps of the disclosed methods may occur. For example, any step that involves contacting a substrate with solution may be performed in such an electroplating cell. While the following description assumes that the apparatus is used for electroplating metal on a substrate (which may occur in operations 103 of FIG. 1A, 113 of FIG. 1B, and 123 of FIG. 1C), it is understood that this apparatus may similarly be used to electroplate a layer of hydrogen onto a substrate, for example as described in relation to operations 101 of FIG. 1A and 111 of FIG. 1B. Similarly, the apparatus may be used for electroless deposition to form the layer of hydrogen and/or the layer of metal. It is similarly understood that references to "plating solution," "plating bath," and similar terms provided in the description of FIGS. 5-7 may apply to any solutions provided to apparatus (e.g., any solutions that contact the substrate as described herein), including solutions used to deposit the surface layer of hydrogen atoms and solutions used to displace the surface layer of hydrogen atoms with a surface layer of metal atoms.

Often, an electroplating apparatus includes one or more electroplating cells in which the substrates (e.g., wafers) are processed. Only one electroplating cell is shown in FIG. 5 to preserve clarity. To optimize bottom-up electroplating, additives (e.g., accelerators, suppressors, and levelers) are sometimes added to the electrolyte; however, an electrolyte with additives may react with the anode in undesirable ways.

Therefore anodic and cathodic regions of the plating cell are sometimes separated by a membrane so that plating solutions of different composition may be used in each region. Plating solution in the cathodic region is called catholyte; and in the anodic region, anolyte. A number of engineering designs can be used in order to introduce anolyte and catholyte into the plating apparatus.

Referring to FIG. 5, a diagrammatical cross-sectional view of an electroplating apparatus 501 in accordance with one embodiment is shown. The plating bath 503 contains the plating solution (having a composition as provided herein), which is shown at a level 505. The catholyte portion of this vessel is adapted for receiving substrates in a catholyte. A wafer 507 is immersed into the plating solution and is held by, e.g., a "clamshell" substrate holder 509, mounted on a rotatable spindle 511, which allows rotation of clamshell substrate holder 509 together with the wafer 507. A general description of a clamshell-type plating apparatus having aspects suitable for use with embodiments herein is described in detail in U.S. Pat. No. 6,156,167 issued to Patton et al., and U.S. Pat. No. 6,800,187 issued to Reid et al., which are incorporated herein by reference in their entireties.

An anode 513 is disposed below the wafer within the plating bath 503 and is separated from the wafer region by a membrane 515, preferably an ion selective membrane. For example, Nafion™ cationic exchange membrane (CEM) may be used. The region below the anodic membrane is often referred to as an "anode chamber." The ion-selective anode membrane 515 allows ionic communication between the anodic and cathodic regions of the plating cell, while preventing the particles generated at the anode from entering the proximity of the wafer and contaminating it. The anode membrane is also useful in redistributing current flow during the plating process and thereby improving the plating uniformity. Detailed descriptions of suitable anodic membranes are provided in U.S. Pat. Nos. 6,126,798 and 6,569,299 issued to Reid et al., both incorporated herein by reference in their entireties. Ion exchange membranes, such as cationic exchange membranes, are especially suitable for these applications. These membranes are typically made of ionomeric materials, such as perfluorinated co-polymers containing sulfonic groups (e.g. Nafion™), sulfonated polyimides, and other materials known to those of skill in the art to be suitable for cation exchange. Selected examples of suitable Nafion™ membranes include N324 and N424 membranes available from Dupont de Nemours Co.

During plating the ions from the plating solution are deposited on the substrate. The metal ions (or hydrogen ions) must diffuse through the diffusion boundary layer and, frequently, into the TSV hole or other feature. A typical way to assist the diffusion is through convection flow of the electroplating solution provided by the pump 517. Additionally, a vibration agitation or sonic agitation member may be used as well as wafer rotation. For example, a vibration transducer 508 may be attached to the clamshell substrate holder 509.

The plating solution is continuously provided to plating bath 503 by the pump 517. Generally, the plating solution flows upwards through an anode membrane 515 and a diffuser plate 519 to the center of wafer 507 and then radially outward and across wafer 507. The plating solution also may be provided into the anodic region of the bath from the side of the plating bath 503. The plating solution then overflows plating bath 503 to an overflow reservoir 521. The plating solution is then filtered (not shown) and returned to pump 517 completing the recirculation of the plating solution. In certain configurations of the plating cell, a distinct electrolyte is circulated through the portion of the plating cell in which the anode is contained while mixing with the main plating solution is prevented using sparingly permeable membranes or ion selective membranes.

A reference electrode 531 is located on the outside of the plating bath 503 in a separate chamber 533, which chamber is replenished by overflow from the main plating bath 503. Alternatively, in some embodiments the reference electrode is positioned as close to the substrate surface as possible, and the reference electrode chamber is connected via a capillary tube or by another method, to the side of the wafer substrate or directly under the wafer substrate. In some of the preferred embodiments, the apparatus further includes contact sense leads that connect to the wafer periphery and which are configured to sense the potential of the metal seed layer at the periphery of the wafer but do not carry any current to the wafer.

A reference electrode 531 is typically employed when electroplating at a controlled potential is desired. The reference electrode 531 may be one of a variety of commonly used types such as mercury/mercury sulfate, silver chloride, saturated calomel, or copper metal. A contact sense lead in direct contact with the wafer 507 may be used in some embodiments, in addition to the reference electrode, for more accurate potential measurement (not shown).

A DC power supply 535 can be used to control current flow to the wafer 507. The power supply 535 has a negative output lead 539 electrically connected to wafer 507 through one or more slip rings, brushes and contacts (not shown). The positive output lead 541 of power supply 535 is electrically connected to an anode 513 located in plating bath 503. The power supply 535, a reference electrode 531, and a contact sense lead (not shown) can be connected to a system controller 547, which allows, among other functions, modulation of current and potential provided to the elements of electroplating cell. For example, the controller may allow electroplating in potential-controlled and current-controlled regimes. The controller may include program instructions specifying current and voltage levels that need to be applied to various elements of the plating cell, as well as times at which these levels need to be changed. When forward current is applied, the power supply 535 biases the wafer 507 to have a negative potential relative to anode 513. This causes an electrical current to flow from anode 513 to the wafer 507, and an electrochemical reduction (e.g. $Cu^{2+}+2e^{-}=Cu^{0}$) occurs on the wafer surface (the cathode), which results in the deposition of the electrically conductive layer (e.g. copper) on the surfaces of the wafer. An inert anode 514 may be installed below the wafer 507 within the plating bath 503 and separated from the wafer region by the membrane 515.

The apparatus may also include a heater 545 for maintaining the temperature of the plating solution at a specific level. The plating solution may be used to transfer the heat to the other elements of the plating bath. For example, when a wafer 507 is loaded into the plating bath the heater 545 and the pump 517 may be turned on to circulate the plating solution through the electroplating apparatus 501, until the temperature throughout the apparatus becomes substantially uniform. In one embodiment the heater is connected to the system controller 547. The system controller 547 may be connected to a thermocouple to receive feedback of the plating solution temperature within the electroplating apparatus and determine the need for additional heating.

The controller will typically include one or more memory devices and one or more processors. The processor may include a CPU or computer, analog and/or digital input/output connections, stepper motor controller boards, etc. In certain embodiments, the controller controls all of the activities of the electroplating apparatus. Non-transitory machine-readable media containing instructions for controlling process operations in accordance with the present embodiments may be coupled to the system controller.

Typically there will be a user interface associated with controller 547. The user interface may include a display screen, graphical software displays of the apparatus and/or process conditions, and user input devices such as pointing devices, keyboards, touch screens, microphones, etc. The computer program code for controlling electroplating processes can be written in any conventional computer readable programming language: for example, assembly language, C, C++, Pascal, Fortran or others. Compiled object code or script is executed by the processor to perform the tasks identified in the program. One example of a plating apparatus that may be used according to the embodiments herein is the Lam Research Sabre tool. Electrodeposition can be performed in components that form a larger electrodeposition apparatus.

In some cases, one or more of the steps described herein may be performed in a vessel that is simpler than the apparatus described in FIG. 5. For example, a simpler vessel may be provided for electroless deposition in cases where the hydrogen and/or metal are deposited electrolessly. In such cases, various elements described in relation to FIG. 5 may be omitted in the vessel used to deposit such a layer. Of course, electroplating cells can also be operated in an electroless mode to achieve the same result.

Figure 6:
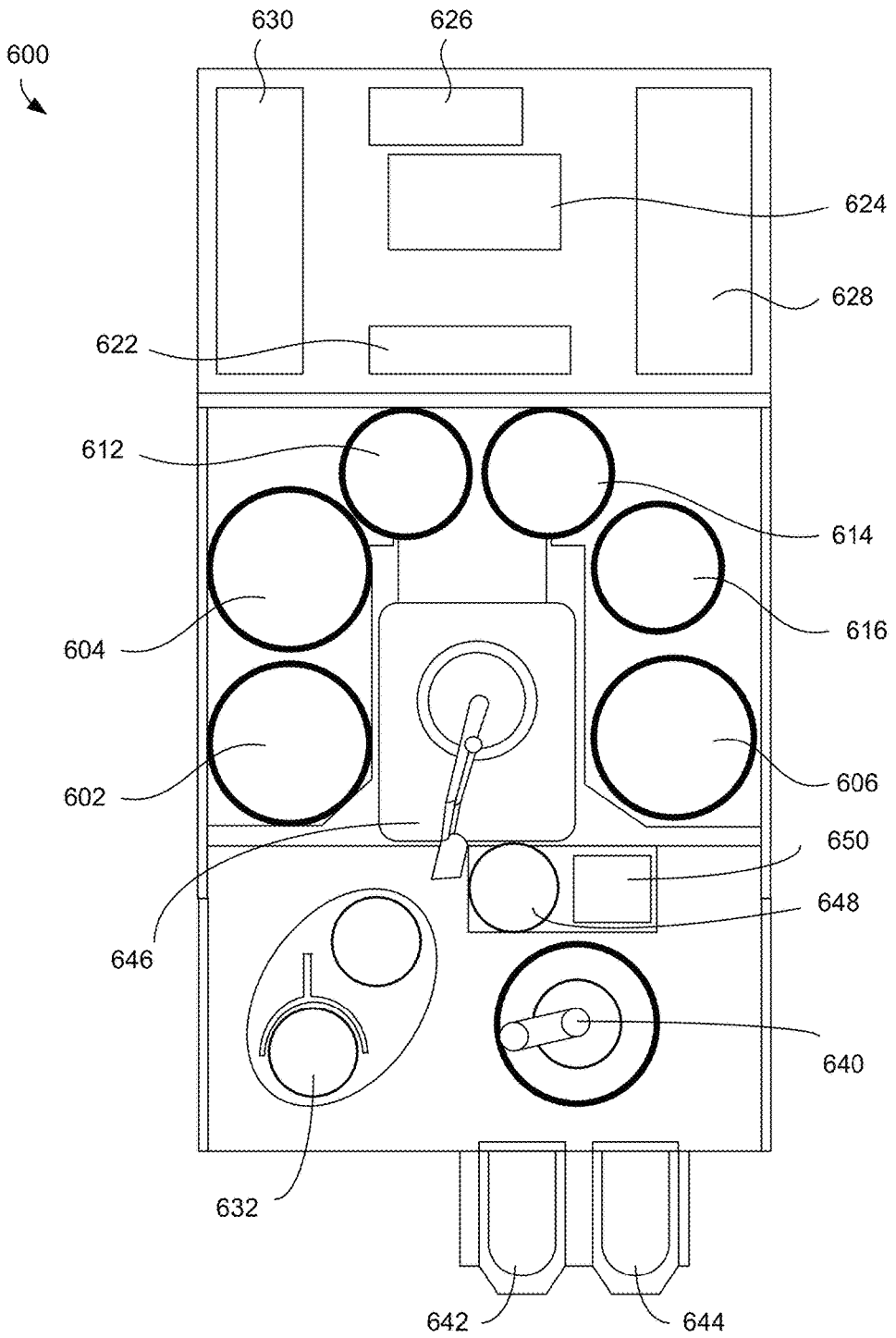
FIGS. 6 and 7 illustrate apparatuses that can be used for plating (e.g., electroplating and/or electroless plating) and various other processes according to certain embodiments herein.

FIG. 6 shows a schematic of a top view of an example electrodeposition apparatus. The electrodeposition apparatus 600 can include three separate electroplating modules 602, 604, and 606. The electrodeposition apparatus 600 can also include three separate modules 612, 614, and 616 configured for various process operations. For example, in some embodiments, one or more of modules 612, 614, and 616 may be a spin rinse drying (SRD) module. In other embodiments, one or more of the modules 612, 614, and 616 may be post-electrofill modules (PEMs), each configured to perform a function, such as edge bevel removal, backside etching, and acid cleaning of substrates after they have been processed by one of the electroplating modules 602, 604, and 606. In some embodiments, one or more of the modules 602, 604, 606, 612, 614, and 616 may be configured to perform electroless deposition or vapor-based deposition, for example to form the surface layer of hydrogen on the substrate.

The electrodeposition apparatus 600 includes a central electrodeposition chamber 624. The central electrodeposition chamber 624 is a chamber that holds the chemical solution used as the electroplating solution in the electroplating modules 602, 604, and 606. The electrodeposition apparatus 600 also includes a dosing system 626 that may store and deliver additives for the electroplating solution. A chemical dilution module 622 may store and mix chemicals to be used as an etchant. A filtration and pumping unit 628 may filter the electroplating solution for the central electrodeposition chamber 624 and pump it to the electroplating modules. In some cases, the apparatus 600 includes separate chambers for holding different solutions (e.g., a first solution for forming the surface layer of hydrogen and a second solution for displacing the surface layer of hydrogen with a surface layer of metal, as described in FIG. 1A, for instance), as well as inlets, outlets, valves, pumps, piping, etc., to deliver the different solutions to an appropriate module, as needed.

A system controller 630 provides electronic and interface controls required to operate the electrodeposition apparatus 600. The system controller 630 (which may include one or more physical or logical controllers) controls some or all of the properties of the electroplating apparatus 600.

Signals for monitoring the process may be provided by analog and/or digital input connections of the system controller 630 from various process tool sensors. The signals for controlling the process may be output on the analog and digital output connections of the process tool. Non-limiting examples of process tool sensors that may be monitored include mass flow controllers, pressure sensors (such as manometers), thermocouples, optical position sensors, etc. Appropriately programmed feedback and control algorithms may be used with data from these sensors to maintain process conditions.

A hand-off tool 640 may select a substrate from a substrate cassette such as the cassette 642 or the cassette 644. The cassettes 642 or 644 may be front opening unified pods (FOUPs). A FOUP is an enclosure designed to hold substrates securely and safely in a controlled environment and to allow the substrates to be removed for processing or measurement by tools equipped with appropriate load ports and robotic handling systems. The hand-off tool 640 may hold the substrate using a vacuum attachment or some other attaching mechanism.

The hand-off tool 640 may interface with a wafer handling station 632, the cassettes 642 or 644, a transfer station 650, or an aligner 648. From the transfer station 650, a hand-off tool 646 may gain access to the substrate. The transfer station 650 may be a slot or a position from and to which hand-off tools 640 and 646 may pass substrates without going through the aligner 648. In some embodiments, however, to ensure that a substrate is properly aligned on the hand-off tool 646 for precision delivery to an electroplating module, the hand-off tool 646 may align the substrate with an aligner 648. The hand-off tool 646 may also deliver a substrate to one of the electroplating modules 602, 604, or 606 or to one of the three separate modules 612, 614, and 616 configured for various process operations.

An example of a process operation according to the methods described above may proceed as follows: (1) electrodeposit copper or another material onto a substrate in the electroplating module 604; (2) rinse and dry the substrate in SRD in module 612; and, (3) perform edge bevel removal in module 614.

An apparatus configured to allow efficient cycling of substrates through sequential plating, rinsing, drying, and PEM process operations may be useful for implementations for use in a manufacturing environment. To accomplish this, the module 612 can be configured as a spin rinse dryer and an edge bevel removal chamber. With such a module 612, the substrate would only need to be transported between the electroplating module 604 and the module 612 for the copper plating and EBR operations. In some embodiments the methods described herein will be implemented in a system which comprises an electroplating apparatus and a stepper.

Figure 7:
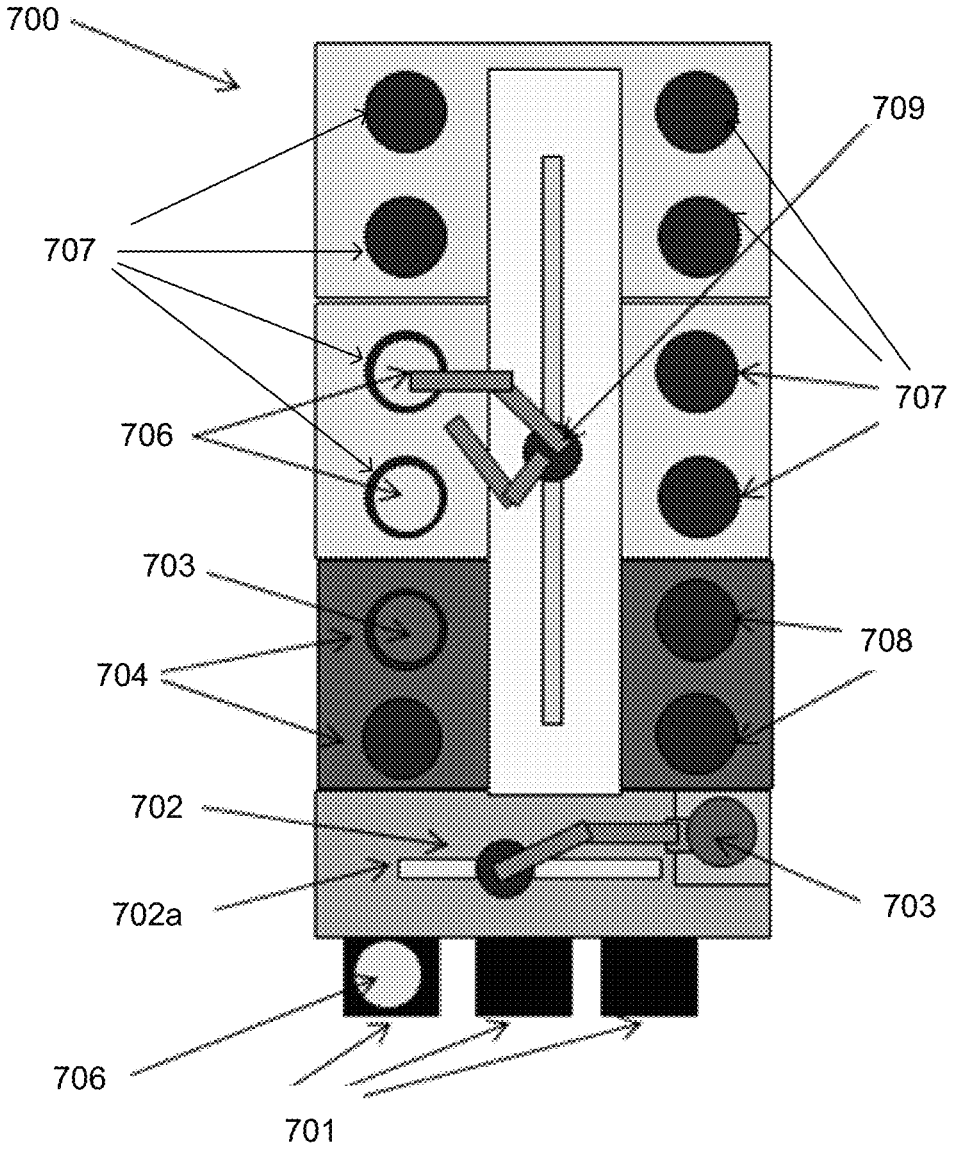

An alternative embodiment of an electrodeposition apparatus 700 is schematically illustrated in FIG. 7. In this embodiment, the electrodeposition apparatus 700 has a set of electroplating cells 707, each containing an electroplating bath, in a paired or multiple "duet" configuration. In addition to electroplating per se, the electrodeposition apparatus 700 may perform a variety of other electroplating related processes and sub-steps, such as spin-rinsing, spin-drying, metal and silicon wet etching, electroless deposition, pre-wetting and pre-chemical treating, reducing, annealing, photoresist stripping, and surface pre-activation, for example. In addition, apparatus 700 may perform other processes such as vapor-based deposition in cases where one or more of the modules or stations (e.g., one or more of electroplating modules 707, front-end accessible stations 708, or additional modules/stations) are modified to include a vapor deposition chamber as described in relation to FIG. 4, for example. The electrodeposition apparatus 700 is shown schematically looking top down in FIG. 7, and only a single level or "floor" is revealed in the figure, but it is to be readily understood by one having ordinary skill in the art that such an apparatus, e.g., the Novellus Sabre™ 3D tool, can have two or more levels "stacked" on top of each other, each potentially having identical or different types of processing stations.

Referring once again to FIG. 7, the substrates 706 that are to be electroplated are generally fed to the electrodeposition apparatus 700 through a front end loading FOUP 701 and, in this example, are brought from the FOUP to the main substrate processing area of the electrodeposition apparatus 700 via a front-end robot 702 that can retract and move a substrate 706 driven by a spindle 703 in multiple dimensions from one station to another of the accessible stations—two front-end accessible stations 704 and also two front-end accessible stations 708 are shown in this example. The front-end accessible stations 704 and 708 may include, for example, pre-treatment stations, and spin rinse drying (SRD) stations. Lateral movement from side-to-side of the front-end robot 702 is accomplished utilizing robot track 702*a*. Each of the substrates 706 may be held by a cup/cone assembly (not shown) driven by a spindle 703 connected to a motor (not shown), and the motor may be attached to a mounting bracket 709. Also shown in this example are the four "duets" of electroplating cells 707, for a total of eight electroplating cells 707. A system controller (not shown) may be coupled to the electrodeposition apparatus 700 to control some or all of the properties of the electrodeposition apparatus 700. The system controller may be programmed or otherwise configured to execute instructions according to processes described earlier herein.

System Controller

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of processing gases, temperature settings (e.g., heating and/or cooling), pressure settings, vacuum settings, power settings, radio frequency (RF) generator settings, RF matching circuit settings, frequency settings, flow rate settings, fluid delivery settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

The various hardware and method embodiments described above may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility.

Lithographic patterning of a film typically comprises some or all of the following steps, each step enabled with a number of possible tools: (1) application of photoresist on a workpiece, e.g., a substrate having a silicon nitride film formed thereon, using a spin-on or spray-on tool; (2) curing of photoresist using a hot plate or furnace or other suitable curing tool; (3) exposing the photoresist to visible or UV or x-ray light with a tool such as a wafer stepper; (4) developing the resist so as to selectively remove resist and thereby pattern it using a tool such as a wet bench or a spray developer; (5) transferring the resist pattern into an underlying film or workpiece by using a dry or plasma-assisted etching tool; and (6) removing the resist using a tool such as an RF or microwave plasma resist stripper. In some embodiments, an ashable hard mask layer (such as an amorphous carbon layer) and another suitable hard mask (such as an antireflective layer) may be deposited prior to applying the photoresist.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above described processes may be changed. Certain references have been incorporated by reference herein. It is understood that any disclaimers or disavowals made in such references do not necessarily apply to the embodiments described herein. Similarly, any features described as necessary in such references may be omitted in the embodiments herein.

The subject matter of the present disclosure includes all novel and nonobvious combinations and sub-combinations of the various processes, systems and configurations, and other features, functions, acts, and/or properties disclosed herein, as well as any and all equivalents thereof.

What is claimed is:

1. A method of depositing a solid material on a substrate, the method comprising:

(a) forming a layer or a partial layer of hydrogen on a surface of the substrate, wherein forming the layer or partial layer of hydrogen comprises reducing hydrogen on the surface of the substrate by contacting the surface of the substrate with hydrogen radicals; and (b) contacting the surface of the substrate with a solution comprising an ion of a material, whereby ions of the material and the hydrogen react to produce no more than about a monolayer of the material on the surface of the substrate to produce a layer or a partial layer of the material on the surface of the substrate.

2. The method of claim 1, further comprising repeating (a) and (b) on the surface of the substrate.

3. The method of claim 1, further comprising repeating (a) and (b) on the surface of the substrate at least about five times.

4. The method of claim 1, further comprising repeating (a) and (b) on the surface of the substrate to form a layer of the material having a thickness of between about 0.5 to 5 nanometers.

5. The method of claim 1, wherein the layer or partial layer of hydrogen formed in (a) has a thickness no greater than about a monolayer.

6. The method of claim 1, wherein (a) comprises adsorbing the hydrogen on the surface of the substrate.

7. The method of claim 1, wherein (a) is performed in an apparatus comprising a chamber having a pedestal configured to support the substrate, and a remote plasma source in communication with the chamber and configured to produce hydrogen radicals.

8. The method of claim 1, wherein the surface of the substrate has recessed features, at least some of which have an aspect ratio of at least about three.

9. The method of claim 1, wherein the surface of the substrate comprises electrically conductive regions or is entirely electrically conductive.

10. The method of claim 1, wherein the surface of the substrate comprises a partially fabricated semiconductor device.

11. The method of claim 1, wherein the material is electrically conductive.

12. The method of claim 1, wherein the material is a metal.

13. The method of claim 12, wherein the metal and its ion has an equilibrium electrochemical reduction potential that is more positive than the equilibrium electrochemical reduction potential of hydrogen gas and aqueous hydrogen ions.

14. The method of claim 12, wherein the metal is selected from the group consisting of gold, copper, silver, germanium, tin, arsenic, bismuth, mercury, palladium, lead, platinum, rhenium, and molybdenum, ruthenium, and combinations thereof.

15. The method of claim 1, wherein the solution comprising the ion of the material is an aqueous solution.

16. The method of claim 1, wherein (a) and (b) are performed in different reaction vessels.

17. A method of depositing a solid material on a substrate, the method comprising:

(a) forming a layer or a partial layer of hydrogen on a surface of the substrate, wherein forming the layer or partial layer of hydrogen comprises reducing hydrogen on the surface of the substrate by contacting the surface of the substrate with hydrogen species in a plasma; and (b) contacting the surface of the substrate with a solution comprising an ion of a material, whereby ions of the material and the hydrogen react to produce no more than about a monolayer of the material on the surface of the substrate to produce a layer or a partial layer of the material on the surface of the substrate.

18. A method of depositing a solid material on a substrate, the method comprising:

(a) forming a layer or a partial layer of hydrogen on a surface of the substrate; and (b) contacting the surface of the substrate with a solution comprising an ion of a material, whereby ions of the material and the hydrogen react to produce no more than about a monolayer of the material on the surface of the substrate to produce a layer or a partial layer of the material on the surface of the substrate, wherein (a) is performed in an apparatus comprising a chamber having a pedestal configured to support the substrate, and a remote plasma source in communication with the chamber and configured to produce hydrogen radicals.

19. The method of claim 18, wherein (b) is performed in an apparatus comprising electrical contacts configured to electrically couple the surface of the substrate to an external circuit, a counter electrode electrically coupled to the external circuit, and a vessel configured to contain the solution comprising the ion of the material.

20. The method of claim 18, wherein (a) comprises adsorbing the hydrogen on the surface of the substrate.

* * * * *